US008670980B2

(12) United States Patent
Satoh

(10) Patent No.: US 8,670,980 B2
(45) Date of Patent: Mar. 11, 2014

(54) TONE DETERMINATION DEVICE AND METHOD

(75) Inventor: Kaoru Satoh, Kanagawa (JP)

(73) Assignee: Panasonic Corporation, Osaka (JP)

( * ) Notice: Subject to any disclaimer, the term of this patent is extended or adjusted under 35 U.S.C. 154(b) by 60 days.

(21) Appl. No.: 13/503,766

(22) PCT Filed: Oct. 26, 2010

(86) PCT No.: PCT/JP2010/006329
§ 371 (c)(1),
(2), (4) Date: Apr. 24, 2012

(87) PCT Pub. No.: WO2011/052191
PCT Pub. Date: May 5, 2011

(65) Prior Publication Data

US 2012/0215524 A1 Aug. 23, 2012

(30) Foreign Application Priority Data

Oct. 26, 2009 (JP) ..... 2009-245624

(51) Int. Cl.
*G10L 19/02* (2013.01)

(52) U.S. Cl.
USPC ..... 704/203; 704/208; 704/243; 704/260; 375/254; 375/260; 375/406.01; 706/20

(58) Field of Classification Search
USPC ..... 375/254, 260, 406.01; 704/208, 209, 704/243, 260; 706/20
See application file for complete search history.

(56) References Cited

U.S. PATENT DOCUMENTS

| | | | | |
|---|---|---|---|---|
| 5,579,435 | A | 11/1996 | Jansson | |
| 5,642,466 | A * | 6/1997 | Narayan | 704/260 |
| 5,774,837 | A * | 6/1998 | Yeldener et al. | 704/208 |
| 6,182,036 | B1 * | 1/2001 | Poppert | 704/243 |
| 6,233,550 | B1 * | 5/2001 | Gersho et al. | 704/208 |
| 6,892,193 | B2 * | 5/2005 | Bolle et al. | 706/20 |
| 7,065,485 | B1 * | 6/2006 | Chong-White et al. | 704/208 |
| 2003/0016815 | A1 * | 1/2003 | Kurtz et al. | 379/406.01 |
| 2003/0043925 | A1 * | 3/2003 | Stopler et al. | 375/254 |
| 2005/0018763 | A1 * | 1/2005 | Bonaventura | 375/222 |
| 2005/0267741 | A1 * | 12/2005 | Laaksonen et al. | 704/209 |
| 2007/0153904 | A1 * | 7/2007 | Itoh et al. | 375/240.16 |
| 2008/0049855 | A1 * | 2/2008 | Duvaut et al. | 375/260 |
| 2009/0271204 | A1 | 10/2009 | Tammi | |
| 2011/0301946 | A1 | 12/2011 | Satoh et al. | |

FOREIGN PATENT DOCUMENTS

| | | |
|---|---|---|
| WO | 95/12879 | 5/1995 |
| WO | 2007/052088 | 5/2007 |
| WO | 2010/098130 | 9/2010 |

* cited by examiner

*Primary Examiner* — Michael Colucci
(74) *Attorney, Agent, or Firm* — Greenblum & Bernstein, P.L.C.

(57) ABSTRACT

A tone determination device, which determines the tonality of an input signal, is capable of reducing calculation complexity. Therein a frequency conversion unit (101) converts the frequency of an input signal; a downsampling unit (102) carries out shortening processing which shortens the vector series length of the frequency-converted signal; a constancy determination unit (107) determines the constancy of the input signal; depending on the constancy of the input signal, a vector selection unit (104) selects either the vector series of the post-frequency conversion signal or the vector series after the shortening of the vector series length; a correlation analysis unit (105) uses the vector series selected by the vector selection unit (104) to obtain correlations; and a tone determination unit (106) uses the correlations to determine the tonality of the input signal.

9 Claims, 6 Drawing Sheets

TONE DETERMINATION DEVICE AND METHOD

TECHNICAL FIELD

The present invention relates to a tone determination apparatus and a tone determination method.

BACKGROUND ART

In digital wireless communication and packet communication represented by the Internet communication or in the field of speech accumulation and the like, a speech signal coding/decoding technique is indispensable for effective utilization of the capacity of a transmission line for radio waves and the like or a storage medium, and many speech coding/decoding systems have been developed up to now. Among such systems, a CELP (Code Excited Linear Prediction) speech coding/decoding system has been practically applied as a mainstream system.

A CELP speech coding apparatus encodes an input speech on the basis of a speech model stored in advance. Specifically, the CELP speech coding apparatus separates a digitalized speech signal into frames of about 10 to 20 ms, performs linear prediction analysis of the speech signal for each frame, determines a linear prediction coefficient and a linear prediction residual vector, and encodes each of the linear prediction coefficient and the linear prediction residual vector separately.

A variable rate coding apparatus has also been realized which changes a bit rate according to an input signal. In the variable rate coding apparatus, it is possible to encode an input signal at a high bit rate if the input signal mainly includes a lot of speech information and encode the input signal at a low bit rate if the input signal mainly includes a lot of noise information. That is, if a lot of important information is included, high-quality coding is performed to realize the high quality of an output signal reproduced on the decoding apparatus side. On the other hand, if importance is low, the power, the transmission band and the like can be saved by low-quality coding. In this way, by detecting features of an input signal (for example, voicedness, unvoicedness, tonality and the like) and changing a coding method according to the result of the detection, it is possible to perform coding suitable for the features of the input signal and improve coding performance.

As a method for classifying an input signal into speech information or noise information, a VAD (Voice Active Detector) exists. Specifically, there are methods such as (1) a method in which an input signal is quantized to classify the class thereof, and classification of speech information/noise information is performed on the basis of class information, (2) a method in which the fundamental period of an input signal is determined, and classification of speech information/noise information is performed according to the level of correlation between a signal earlier than a current signal by the length of the fundamental period and the current signal, and (3) a method in which temporal variation in frequency components of an input signal is examined, and classification of speech information/noise information is performed according to variation information.

There is also a technique in which frequency components of an input signal are determined by SDFT (Shifted Discrete Fourier Transform), and the tonality of the input signal is classified according to the level of correlation between the frequency components of a current frame and the frequency components of a previous frame (for example, PTL 1). In the above technique disclosed in PTL 1, a frequency band extension method is switched according to the tonality so as to improve coding performance.

CITATION LIST

Patent Literature

PTL 1

International Publication WO2007/052088

SUMMARY OF INVENTION

Technical Problem

However, in a tone determination apparatus as disclosed in the PTL 1 described above, that is, a tone determination apparatus in which frequency components of an input signal (the SDFT coefficients of the input signal) are determined by SDFT, and the tonality of the input signal is detected on the basis of correlation between the SDFT coefficient of a current frame and the SDFT coefficient of a previous frame, there is a problem that the amount of calculation increases because the correlation is determined in consideration of all the frequency bands of the SDFT coefficients.

The present invention has been made in view of the above problem, and the object of the present invention is to reduce the amount of calculation in a tone determination apparatus and tone determination method for determining frequency components of an input signal (SDFT coefficients of the input signal) and determining the tonality of the input signal on the basis of correlation between the SDFT coefficient of a current frame and the SDFT coefficient of a previous frame.

Solution to Problem

A tone determination apparatus of the present invention is configured to include: a transformation section that performs frequency transformation of an input signal; a shortening section that performs shortening processing for shortening a vector sequence length of the frequency-transformed signal; a stationarity determination section that determines stationarity of the input signal; a selection section that selects any of a vector sequence of the frequency-transformed signal and a vector sequence after the shortening of the vector sequence length, according to the stationarity of the input signal; a correlation section that determines correlation using the vector sequence selected by the selection section; and a tone determination section that determines tonality of the input signal using the correlation.

A tone determination method of the present invention is configured to include: a transformation step of performing frequency transformation of an input signal; a shortening step of performing shortening processing for shortening a vector sequence length of the frequency-transformed signal; a stationarity determination step of determining stationarity of the input signal; a selection step of selecting any of a vector sequence of the frequency-transformed signal and a vector sequence after the shortening of the vector sequence length, according to the stationarity; a correlation step of determining correlation using the vector sequence selected at the selection step; and a tone determination step of determining tonality of the input signal using the correlation.

Advantageous Effects of Invention

According to the present invention, it is possible to reduce the amount of calculation required for tone determination.

DESCRIPTION OF EMBODIMENTS

Embodiments of the present invention will be described in detail with reference to accompanying drawings.

Embodiment 1

Figure 1:
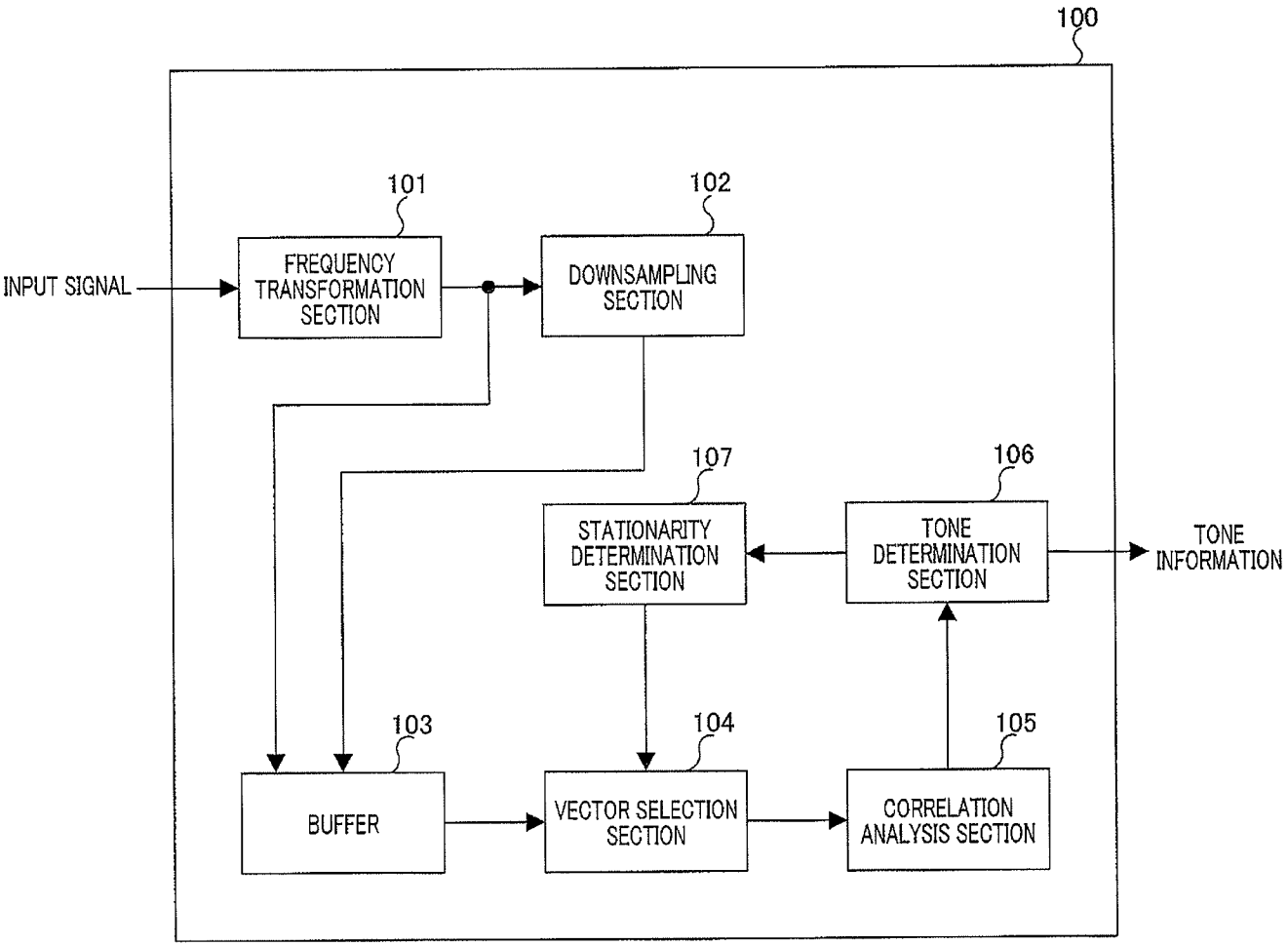
FIG. 1 is a block diagram showing main components of a tone determination apparatus according to Embodiment 1 of the present invention.

FIG. 1 is a block diagram showing main components of tone determination apparatus 100 according to this embodiment. Here, the case where tone determination apparatus 100 determines the tonality of an input signal and outputs a determination result will be described as an example.

In FIG. 1, frequency transformation section 101 performs frequency transformation of an input signal using SDFT, and outputs an SDFT coefficient which is a frequency component determined by the frequency transformation (a vector sequence of the frequency-transformed signal) to downsampling section 102 and buffer 103.

Downsampling section 102 performs downsampling processing of the SDFT coefficient inputted from frequency transformation section 101, to perform shortening processing for shortening the sequence length of the SDFT coefficient (i.e. the vector sequence length of the frequency-transformed signal). Then, downsampling section 102 outputs the downsampled SDFT coefficient (the vector sequence after the shortening of the vector sequence length) to buffer 103.

Buffer 103 internally stores the SDFT coefficient of a previous frame and the downsampled SDFT coefficient of the previous frame, and outputs these two SDFT coefficients to vector selection section 104. Next, when the SDFT coefficient of a current frame and the downsampled SDFT coefficient of the current frame are inputted from frequency transformation section 101 and downsampling section 102, respectively, buffer 103 outputs these two SDFT coefficients to vector selection section 104. Then, by exchanging the above two internally stored SDFT coefficients of the previous frame (the SDFT coefficient of the previous frame and the downsampled SDFT coefficient of the previous frame) with the above two SDFT coefficients of the current frame (the SDFT coefficient of the current frame and the downsampled SDFT coefficient of the current frame), respectively, buffer 103 updates the SDFT coefficients internally stored in buffer 103.

The SDFT coefficient of the previous frame, the downsampled SDFT coefficient of the previous frame, the SDFT coefficient of the current frame and the downsampled SDFT coefficient of the current frame are inputted to vector selection section 104 from buffer 103, and stationarity information is also inputted to vector selection section 104 from stationarity determination section 107. Here, the stationarity information is information instructing vector selection section 104 how vector determination is to be performed on the basis of a determination result by stationarity determination section 107 determining the stationarity of the tonality of an input signal. Next, vector selection section 104 determines an SDFT coefficient to be used for tone determination by tone determination section 106, according to the stationarity information. Specifically, vector selection section 104 selects any of the SDFT coefficient determined by frequency transformation (the vector sequence of the frequency-transformed signal) and the downsampled SDFT coefficient (the vector sequence after the shortening of the vector sequence length). Then, vector selection section 104 outputs the selected SDFT coefficient to correlation analysis section 105.

Using the SDFT coefficient of the previous frame and the SDFT coefficient of the current frame inputted from vector selection section 104, correlation analysis section 105 determines correlation of the SDFT coefficients between the frames, and outputs the determined correlation to tone determination section 106.

Tone determination section 106 determines the tonality of the input signal using the value of the correlation inputted from correlation analysis section 105. Then, tone determination section 106 outputs tone information indicating a determination result to stationarity determination section 107. Tone determination section 106 outputs the tone information as output of tone determination apparatus 100.

The tone information is inputted to stationarity determination section 107 from tone determination section 106. Stationarity determination section 107 internally stores past tone information. Stationarity determination section 107 determines the stationarity of the tonality of the input signal on the basis of the tone information inputted from tone determination section 106 and the past tone information. Then, stationarity determination section 107 outputs a determination result to vector selection section 104 as stationarity information. This stationarity information is used by vector selection section 104 at the time of performing tone determination of the next frame. Stationarity determination section 107 internally stores the tone information inputted from tone determination section 106 as past tone information.

Next, an operation of tone determination apparatus 100 will be described with the case where the order of an input signal targeted by tone determination is 2N (N is an integer of 1 or more) as an example. In the description below, the input signal is denoted by $x(n)$ ($n=0, 1, \ldots, 2N-1$).

When the input signal $x(n)$ ($n=0, 1, \ldots, 2N-1$) is inputted, frequency transformation section 101 performs frequency transformation in accordance with equation 1 below and outputs an obtained SDFT coefficient $Y(k)$ ($k=0, 1, \ldots, N$) to downsampling section 102 and buffer 103.

(Equation 1)

$$Y(k) = \sum_{n=0}^{2N-1} h(n)x(n)\exp(i2\pi(n+u)(k+v)/2N) \quad [1]$$

Here, h(n) denotes a window function, and the MDCT window function or the like is used. Furthermore, u denotes a temporal shift coefficient, and v denotes a frequency shift coefficient. For example, u=(N+1)/2 and v=½ are set.

When the SDFT coefficient Y(k) (k=0, 1, . . . , N) is inputted from frequency transformation section 101, downsampling section 102 performs downsampling processing in accordance with equation 2 below.

(Equation 2)

$$Y_re(m)=j0\cdot Y)n-1)+j1\cdot Y(n)+j2\cdot Y(n+1)+j3\cdot Y(n+2) \quad [2]$$

Here, n=m×2 is satisfied, and m takes a value from 1 to N/2−1. In the case of m=0, Y_re(0)=Y(0) may be set without performing downsampling. Here, for filter coefficients [j0, j1, j2, j3], low pass filter coefficients designed so as to prevent aliasing distortion from occurring are set. For example, it is known that, if j0=0.195, j1=0.3, j2=0.3 and j3=0.195 are set when the sampling frequency of an input signal is 32000 Hz, a favorable result is obtained.

Then, downsampling section 102 outputs the downsampled SDFT coefficient Y_re(k) (k=0, 1, . . . , N/2−1) to buffer 103.

The SDFT coefficient Y(k) (k=0, 1, . . . , N) and the downsampled SDFT coefficient Y_re(k) (k=0, 1, . . . , N/2−1) are inputted to buffer 103 from frequency transformation section 101 and downsampling section 102, respectively. Buffer 103 outputs the SDFT coefficient of the previous frame, Y_pre(k) (k=0, 1, . . . , N) and the downsampled SDFT coefficient of the previous frame, Y_re_pre(k) (k=0, 1, . . . , N/2−1) which are internally stored in buffer 103, to vector selection section 104. Buffer 103 also outputs the SDFT coefficient of the current frame, Y_re(k) (k=0, 1, . . . , N) and the downsampled SDFT coefficient of the current frame, Y_re(k) (k=0, 1, . . . , N/2−1) to vector selection section 104. Then, buffer 103 internally stores the SDFT coefficient of the current frame, Y(k) (k=0, 1, . . . , N) as Y_pre(k) (k=0, 1, . . . , N), and internally stores the downsampled SDFT coefficient of the current frame, Y_re(k) (k=0, 1, . . . , N/2−1) as Y_re_pre(k) (k=0, 1, . . . , N/2−1). That is, buffer 103 performs update of buffer 103 by exchanging the SDFT coefficient of the current frame with the SDFT coefficient of the previous frame.

The SDFT coefficient of the current frame, Y(k) (k=0, 1, . . . , N), the downsampled SDFT coefficient of the current frame, Y_re(k) (k=0, 1, . . . , N/2−1), the SDFT coefficient of the previous frame, Y_pre(k) (k=0, 1, . . . , N) and the downsampled SDFT coefficient of the previous frame, Y_re_pre(k) (k=0, 1, . . . , N/2−1) are inputted to vector selection section 104 from buffer 103, and stationarity information SI is also inputted to vector selection section 104 from stationarity determination section 107. Next, vector selection section 104 determines an SDFT coefficient to be outputted to correlation analysis section 105, according to stationarity information SI.

Here, description will be made on the case where stationarity information SI shows any of the following two: SI=0 (in the case where the input signal does not have stationarity) and SI=1 (in the case where the input signal has stationarity). In the case of stationarity information SI=0 (in the case where the input signal does not have stationarity), vector selection section 104 selects the undownsampled SDFT coefficients. Then, vector selection section 104 outputs stationarity information SI, the SDFT coefficient of the current frame, Y(k) (k=0, 1, . . . , N) and the SDFT coefficient of the previous frame, Y_pre(k) (k=0, 1, . . . , N) to correlation analysis section 105.

On the other hand, in the case of stationarity information SI=1 (in the case where the input signal has stationarity), vector selection section 104 selects the downsampled SDFT coefficients. Then, vector selection section 104 outputs stationarity information SI, the downsampled SDFT coefficient of the current frame, Y_re(k) (k=0, 1, . . . , N/2−1) and the downsampled SDFT coefficient of the previous frame Y_re_pre(k) (k=0, 1, . . . , N/2−1) to correlation analysis section 105.

When stationarity information SI and the SDFT coefficients are inputted from vector selection section 104, correlation analysis section 105 calculates correlation of the SDFT coefficients between the frames according to stationarity information SI. Specifically, in the case of SI=0, correlation analysis section 105 determines correlation S in accordance with equation 3 below.

(Equation 3)

$$S = \frac{\sum_{k=0}^{N} (|Y(k)| - |Y_pre(k)|)^2}{\sum_{k=0}^{N} (|Y(k)|)^2} \quad [3]$$

On the other hand, in the case of SI=1, correlation analysis section 105 determines correlation S in accordance with equation 4 below.

(Equation 4)

$$S = \frac{\sum_{k=0}^{N/2-1} (|Y_re(k)| - |Y_re_pre(k)|)^2}{\sum_{k=0}^{N/2-1} (|Y_re(k)|)^2} \times 2 \quad [4]$$

Then, correlation analysis section 105 outputs determined correlation S to tone determination section 106.

Tone determination section 106 determines tonality using correlation S inputted from correlation analysis section 105 and outputs the determined tonality as tone information. Specifically, tone determination section 106 can compare correlation S with threshold T, which is a reference value of tone determination, and determine the current frame to be "toned" if T>S is satisfied and "untoned" if T>S is not satisfied. As for the value of threshold T, a statistically appropriate value can be determined by learning. Tonality may be determined by a method disclosed in PTL 1 described above. Multiple thresholds may be set to determine the degree of tone by stages. Then, tone determination section 106 outputs the tone information (for example, "toned" and "untoned" are indicated by 1 and 0, respectively) to stationarity determination section 107.

Stationarity determination section 107 determines the stationarity of the tonality of the input signal using the tone information inputted from tone determination section 106. For example, stationarity determination section 107 refers to the inputted tone information and tone information inputted in the past, determines that the tonality of the input signal has stationarity if a predetermined number or more of such frames that the tonality indicated in the tone information is "toned" continuously exist before the current frame, and sets stationarity information SI to SI=1. Then, stationarity determination section 107 outputs stationarity information SI (=1) to vector selection section 104 at the time of performing tone determination processing of the next frame. This means instructing vector selection section 104 and correlation analysis section 105 to calculate correlation S using the downsampled SDFT coefficients putting importance on reduction in the amount of calculation, in consideration of the fact that the input signal is relatively stable in the state of "toned".

On the other hand, if a predetermined number or more of such frames that the tonality indicated in the tone information is "toned" do not continuously exist before the current frame, stationarity determination section 107 determines that the tonality of the input signal does not have stationarity and sets stationarity information SI to SI=0. Then, stationarity determination section 107 outputs stationarity information SI (=0) to vector selection section 104 at the time of performing tone determination processing of the next frame. This means instructing vector selection section 104 and correlation analysis section 105 to calculate correlation S detailedly and accurately using the undownsampled SDFT coefficients, in consideration of the fact that the tonality of the input signal is unstable.

Figure 2A:
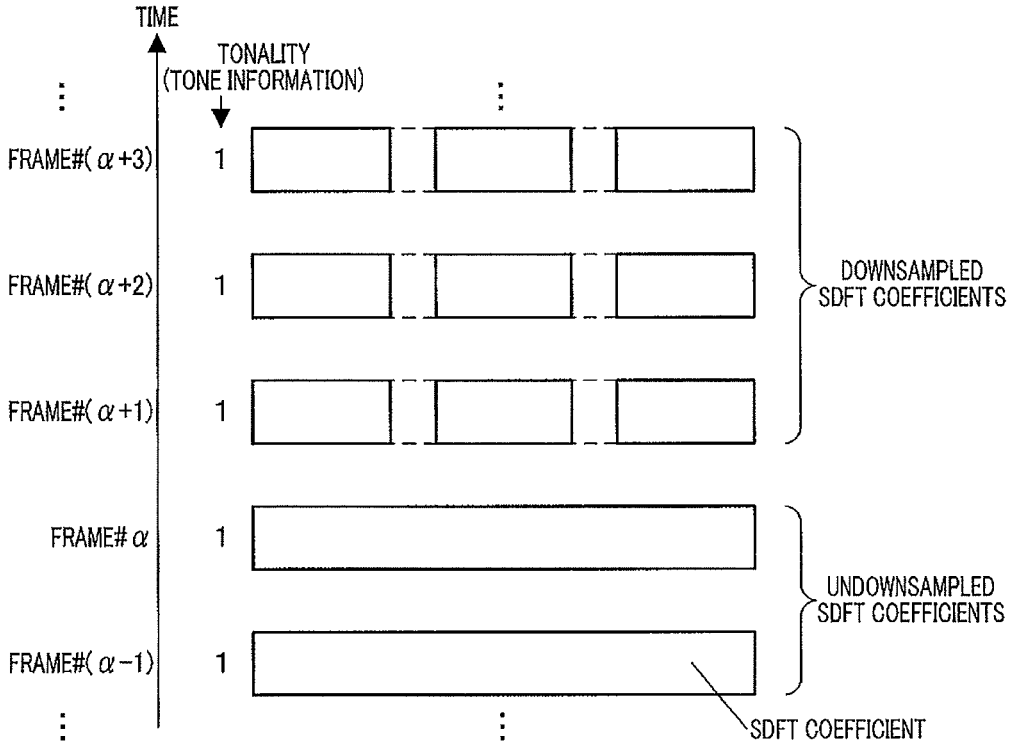
FIG. 2A is a diagram showing a state of SDFT coefficient shortening processing according to Embodiment 1 of the present invention.
Figure 2B:
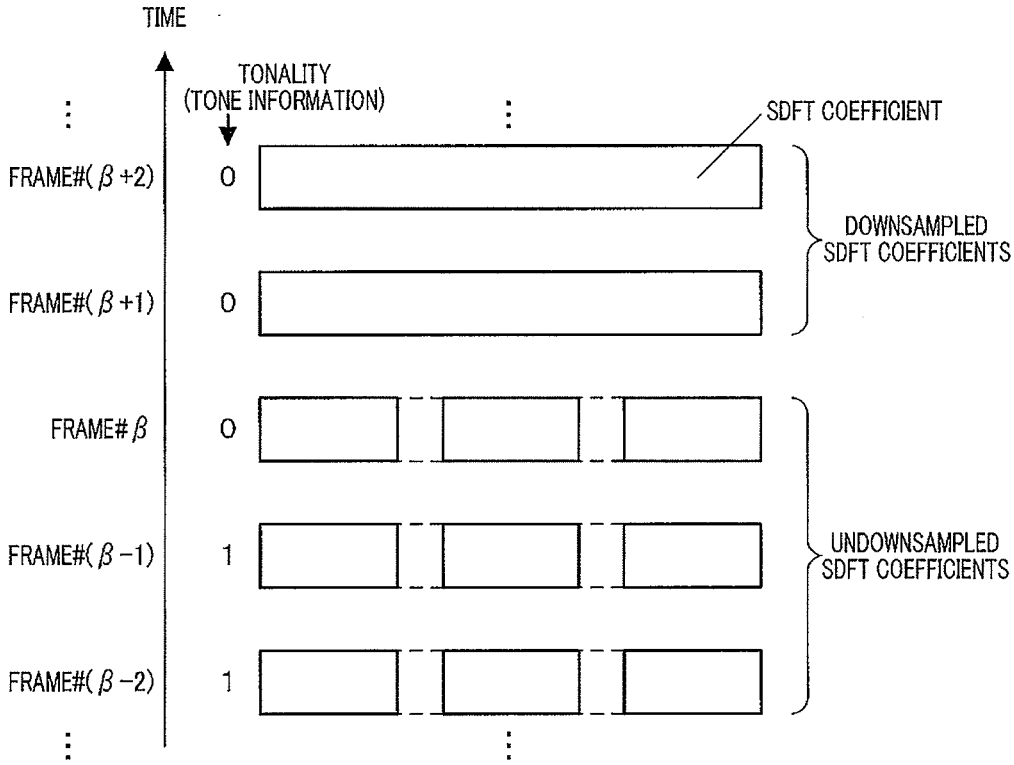
FIG. 2B is a diagram showing a state of the SDFT coefficient shortening processing according to Embodiment 1 of the present invention.

Here, a state of SDFT coefficient (vector sequence) shortening processing in tone determination apparatus 100 is as shown in FIG. 2A and FIG. 2B. In FIG. 2A and FIG. 2B, it is assumed that tone information in the case where the tonality of an input signal is determined to be "toned" by tone determination section 106 is "1", and tone information in the case where the tonality of the input signal is determined to be "untoned" by tone determination section 106 is "0".

For example, it is assumed that, for frame #(α−1) shown in FIG. 2A, a predetermined number or more of such frames that the tone information indicates 1 (i.e. "toned") do not continuously exist before the current frame. Therefore, stationarity determination section 107 determines that the tonality of the input signal does not have stationarity and sets stationarity information SI to SI=0. Then, stationarity determination section 107 outputs stationarity information SI=0 to vector selection section 104 at the time of performing tone determination processing of the next frame #α.

Therefore, since stationarity information SI inputted from stationarity determination section 107 is SI=0 for frame #α shown in FIG. 2A, vector selection section 104 selects the undownsampled SDFT coefficients (the SDFT coefficient Y(k) of the current frame (frame #α shown in FIG. 2A)), and the SDFT coefficient Y_pre(k) of the previous frame (frame #(α−1) shown in FIG. 2A)). Then, vector selection section 104 outputs stationarity information SI (=0) and the selected SDFT coefficients (vector sequences) to correlation analysis section 105.

Next, since stationarity information SI inputted from vector selection section 104 is SI=0, correlation analysis section 105 determines correlation S in accordance with above equation 3. If the tonality of the input signal does not have stationarity, correlation analysis section 105 determines correlation S using the undownsampled SDFT coefficients.

Next, it is assumed that, for frame #α shown in FIG. 2A, the tonality determined by tone determination section 106 is "toned" (i.e. tone information indicates 1). It is also assumed that, for frame #α shown in FIG. 2A, a predetermined number or more of such frames that the tone information indicates 1 (i.e. "toned") continuously exist before the current frame. Therefore, stationarity determination section 107 determines that the tonality of the input signal has stationarity and sets stationarity information SI to SI=1. Then, stationarity determination section 107 outputs stationarity information SI=1 to vector selection section 104 at the time of performing tone determination processing of the next frame #(α+1).

Therefore, since stationarity information SI inputted from stationarity determination section 107 is SI=1 for frame #(α+1) shown in FIG. 2A, vector selection section 104 selects the downsampled SDFT coefficients (the downsampled SDFT coefficient Y_re(k) of the current frame (frame #(α+1) shown in FIG. 2A), and the downsampled SDFT coefficient Y_re_pre(k) of the previous frame (frame #α shown in FIG. 2A)). Then, vector selection section 104 outputs stationarity information SI (=1) and the selected SDFT coefficients (vector sequences) to correlation analysis section 105.

Next, since stationarity information SI inputted from vector selection section 104 is SI=1, correlation analysis section 105 determines correlation S in accordance with above equation 4. If the tonality of the input signal has stationarity, correlation analysis section 105 determines correlation S using the downsampled SDFT coefficients.

In FIG. 2A, if a predetermined number or more of such frames that the tone information indicates "toned" continuously exist before the current frame at and after frame #(α+2), vector selection section 104 selects the downsampled SDFT coefficients for the next frame, and correlation analysis section 105 determines correlation S using the downsampled SDFT coefficients as in the case of frame #(α+1) described above.

In this way, in the case where a predetermined number or more of frames the tonality of which is "toned" continuously exist before a current frame (for example, in the case where a speech section or a music section continues), tone determination apparatus 100 determines that the input signal is stationary (a state in which the tonality of the input signal is stable). Then, in the state in which the tonality is stable, tone determination apparatus 100 determines correlation S using downsampled SDFT coefficients, that is, SDFT coefficients the sequence length of which has been shortened. Thus, it is thought that, in the state in which the tonality is stable, the tonality is strengthened (S<<T is satisfied between correlation S and threshold T). Therefore, on the basis of the fact that, even if tonality determination is performed with a relatively rough accuracy, favorable determination can be performed, tone determination apparatus 100 can reduce the amount of calculation to the extent that an error in tonality determination is not caused by shortening the sequence length of SDFT coefficients.

Next, it is assumed that, for example, for frames #(β−2) and #(β−1) shown in FIG. 2B, a predetermined number or more of such frames that the tone information indicates 1 (i.e. "toned") continuously exist before a current frame. Therefore, stationarity determination section 107 determines that the tonality of the input signal has stationarity and sets stationarity information SI to SI=1. Then, stationarity determination section 107 outputs stationarity information SI=1 to vector selection section 104 at the time of performing tone determination processing of the next frames #(β−1) and #β. Then, as in the case of frame #(α+1) shown in FIG. 2A, vector selection section 104 selects downsampled SDFT coefficients for frames #(β−1) and #β, and correlation analysis section 105 determines correlation S in accordance with the above equation 4.

Next, it is assumed that the tonality determined by tone determination section 106 is "untoned" (i.e. the tone information indicates 0) for frame #β shown in FIG. 2B. That is, for frame #β shown in FIG. 2B, a predetermined number or more of such frames that the tone information indicates 1 (i.e. "toned") do not continuously exist before the current frame. Therefore, stationarity determination section 107 determines that the tonality of the input signal does not have stationarity and sets stationarity information SI to SI=0. Then, stationarity determination section 107 outputs stationarity information SI=0 to vector selection section 104 at the time of performing tone determination processing of the next frame #(β+1).

Therefore, since stationarity information SI inputted from stationarity determination section 107 is SI=0 for frame #(β+1) shown in FIG. 2B, vector selection section 104 selects the undownsampled SDFT coefficients (the SDFT coefficient Y(k) of the current frame (frame #(β+1) shown in FIG. 2B), and the SDFT coefficient Y_pre(k) of the previous frame (frame #β shown in FIG. 2B)). Then, vector selection section 104 outputs stationarity information SI (=0) and the selected SDFT coefficients (vector sequences) to correlation analysis section 105.

Next, since stationarity information SI inputted from vector selection section 104 is SI=0, correlation analysis section 105 determines correlation S in accordance with above equation 3. That is, if the tonality of an input signal does not have stationarity, correlation analysis section 105 determines correlation S using undownsampled SDFT coefficients.

Thus, when a tonality determination result reverses from the state in which the tonality is stable (the case where a predetermined number or more of frames the tonality of which is "toned" continuously exist) (when the tonality reverses to "untoned"), tone determination apparatus 100 determines that the input signal is unstationary (a state in which the tonality of the input signal is unstable). Then, when the tonality determination result reverses from "toned" to "untoned", tone determination apparatus 100 resets shortening of SDFT coefficients, and determines correlation S using undownsampled SDFT coefficients. That is, because of using the whole SDFT coefficient sequence in a state in which the tonality is unstable, tone determination apparatus 100 can determine correlation S between frames detailedly and accurately.

Thus, according to this embodiment, if the tonality of an input signal is stationary, downsampling is performed before determining correlation between frames to shorten SDFT coefficients (vector sequences). Therefore, the length of the SDFT coefficients (vector sequences) used for calculation of correlation is shorter than that conventionally used. Therefore, according to this embodiment, it is possible to reduce the amount of calculation required for determination of the tonality of an input signal.

Furthermore, according to this embodiment, the tone determination apparatus reduces the amount of calculation required for tone determination of an input signal by shortening SDFT coefficients (vector sequences) only in the case where the tonality of the input signal is stable as "toned". On the other hand, in the case of a state in which the tonality of the input signal is unstable, the tone determination apparatus can determine correlation used for tone determination detailedly and accurately by not shortening the SDFT coefficients. That is, in this embodiment, the tone determination apparatus can adaptably switch between tone determination in which the amount of calculation is reduced through a coarse correlation and tone determination in which importance is attached to the correlation accuracy without reducing the amount of calculation, by selecting SDFT coefficients to be used for calculation of correlation between frames, according to the stationarity of the tonality of an input signal.

The number of types of tonality classified by tone determination is normally as small as about two or three (for example, the two types of "toned" and "untoned" in the above description), and a finely-divided determination result is not required. Therefore, there is a strong possibility that, even if SDFT coefficients (vector sequences) are shortened, a classification result similar to that obtained in the case of not shortening the SDFT coefficients (vector sequences) is eventually brought about.

Figure 3:
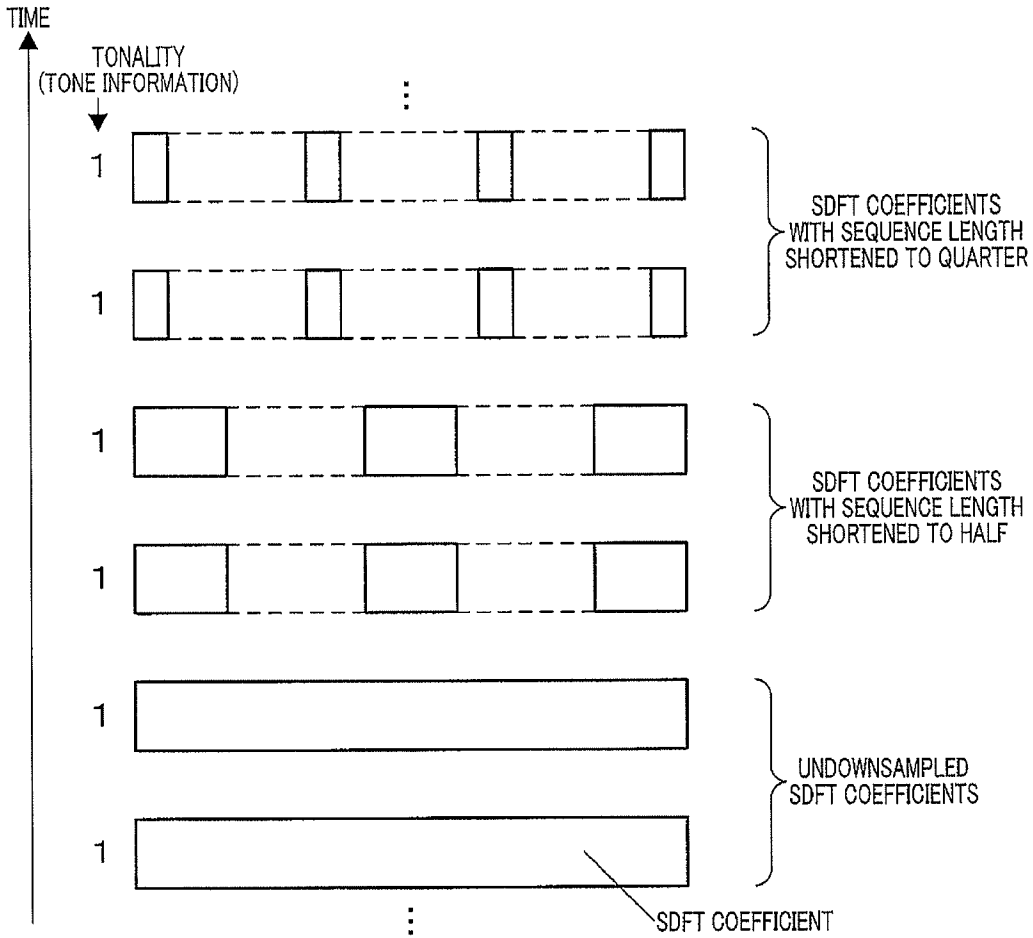
FIG. 3 is a diagram showing another state of the SDFT coefficient shortening processing according to Embodiment 1 of the present invention.

In this embodiment, description has been made on the case where the tone determination apparatus selects undownsampled SDFT coefficients or downsampled SDFT coefficients according to the stationarity of the tonality of an input signal, as an example. In the present invention, however, the tone determination apparatus may change the degree of shortening of SDFT coefficients according to the duration during which an input signal is stationary. For example, as shown in FIG. 3, in addition to undownsampled (unshortened) SDFT coefficients, tone determination apparatus 100 determines the SDFT coefficients with a sequence length shortened to a half and the SDFT coefficients with a sequence length shortened to a quarter. If the tonality of an input signal is stable in the state of "toned", tone determination apparatus 100 may gradually change SDFT coefficients used for tone determination to a sequence with a shorter sequence length as the duration of being stable is longer. Thereby, it is possible to reduce the amount of calculation required for determination of the tonality of an input signal more as the time (duration) during which the tonality of the input signal is stationary is longer.

Embodiment 2

In the case where the sequence lengths of SDFT coefficients (vector sequences) are shortened as in Embodiment 1, the accuracy of tone determination slightly deteriorates. Therefore, identification between "toned" and "untoned" may become unclear as tonality determination using shortening of SDFT coefficients is continued, which may lead to erroneous tone determination.

Therefore, when identification between "toned" and "untoned" becomes unclear, a tone determination apparatus according to this embodiment halts shortening of SDFT coefficients and performs detailed and accurate tone determination processing.

This embodiment will be specifically described below.

In tone determination apparatus 100 (FIG. 1) according to this embodiment, tone determination section 106 determines that, if the distance between correlation S inputted from correlation analysis section 105 and threshold T which is a reference value of tone determination is short (for example, the difference between correlation S and threshold T $|T-S|$ is below constant C set in advance, that is, $C>|T-S|$ is satisfied), correlation S has reached the neighborhood of threshold T, in addition to processing similar to that of Embodiment 1. That is, if $C>|T-S|$ is satisfied, tone determination section 106 determines that identification between "toned" and "untoned" is unclear. Then, if $C>|T-S|$ is satisfied, tone determination section 106 outputs information indicating that "toned" and "untoned" may soon be reversed (in the near future) (reverse information), to stationarity determination section 107.

The tone information and the reverse information (only in the case where the difference between threshold T and correlation S is below constant C) are inputted to stationarity determination section 107 from tone determination section 106.

When the reverse information is inputted from tone determination section 106, stationarity determination section 107 determines that the stationarity of the tonality of an input signal will be lost soon, sets stationarity information SI to SI=0, and outputs stationarity information SI to vector selection section 104 at the time of performing tone determination processing of the next frame. This means instructing vector selection section 104 and correlation analysis section 105 to calculate correlation S detailedly and accurately using undownsampled SDFT coefficients, in consideration of the fact that the input signal becomes ambiguous between "toned" and "untoned".

That is, if the difference between correlation S and threshold T is below a certain value C (if $C>|T-S|$ is satisfied), vector selection section 104 selects the undownsampled SDFT coefficients even if the tonality of the input signal is stationary.

If the reverse information is not inputted from tone determination section 106, stationarity determination section 107 determines the stationarity of the tonality of the input signal using the tone information inputted from tone determination section 106 as in Embodiment 1.

Figure 4:
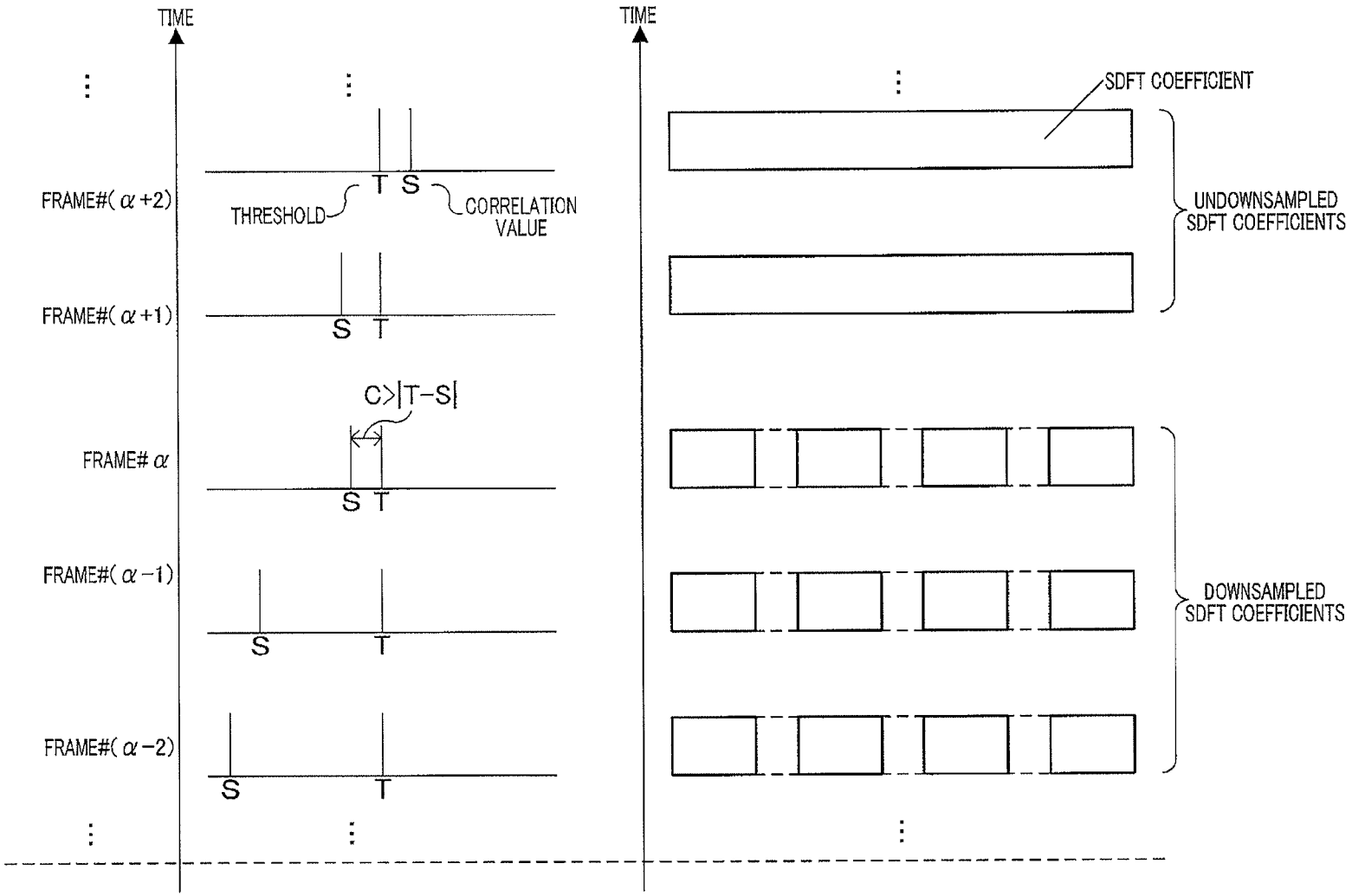
FIG. 4 is a diagram showing a state of SDFT coefficient shortening processing according to Embodiment 2 of the present invention.

Here, a state of SDFT coefficient (vector sequence) shortening processing in tone determination apparatus 100 is as shown in FIG. 4. Since correlation S is smaller than threshold T ($T>S$ is satisfied) for frames #(α−2) and #(α−1) shown in FIG. 4, tone determination section 106 determines that the tonality of the input signal is "toned". Stationarity determination section 107 assumes that, for frames #(α−2) and #(α−1) shown in FIG. 4, a predetermined number or more of frames the tonality of which is "toned" continuously exist before the current frame. Therefore, correlation analysis section 105 determines, for the next frames (frames #(α−1) and #α shown in FIG. 4), the value of correlation between frames using downsampled SDFT coefficients. For frames #(α−2) and #(α−1) shown in FIG. 4, the difference between correlation S and threshold T, ($|T-S|$) is equal to or more constant C ($C\leq|T-S|$).

For frame #α shown in FIG. 4, though correlation S is smaller than threshold T ($T>S$ is satisfied), the difference between correlation S and threshold T, $|T-S|$ is smaller than constant C ($C>|T-S|$). Therefore, tone determination section 106 determines that correlation S has reached the neighborhood of threshold T. Then, tone determination section 106 outputs, for frame #α shown in FIG. 4, reverse information to stationarity determination section 107.

Next, when the reverse information is inputted from tone determination section 106, stationarity determination section 107 determines that the stationarity of the tonality of the input signal may soon be lost and sets stationarity information SI to SI=0. Then, stationarity determination section 107 outputs stationarity information SI=0 to vector selection section 104 at the time of performing tone determination processing of the next frame #(α+1).

Therefore, since stationarity information SI inputted from stationarity determination section 107 is SI=0 for frame #(α+1) shown in FIG. 4, vector selection section 104 selects undownsampled SDFT coefficients (the SDFT coefficient Y(k) of the current frame (frame #(α+1) shown in FIG. 4, and the SDFT coefficient Y_pre(k) of the previous frame (frame #α shown in FIG. 4)). Then, vector selection section 104 outputs stationarity information SI=0 and the selected SDFT coefficients (vector sequences) to correlation analysis section 105.

Next, since stationarity information SI inputted from vector selection section 104 is SI=0, correlation analysis section 105 determines correlation S in accordance with above equation 3. That is, if the tonality of the input signal may soon be reversed (i.e. the stationarity of the tonality of the input signal may soon be lost), correlation analysis section 105 determines correlation S using the undownsampled SDFT coefficients.

In this way, if the difference between correlation S and threshold T is below constant C, that is, correlation S is in the neighborhood of threshold T, tone determination apparatus 100 determines that identification between "toned" and "untoned" is unclear, leading to a condition that is highly prone to erroneous tone determination. Then, if correlation S is in the neighborhood of threshold T, tone determination apparatus 100 resets shortening of SDFT coefficients and determines correlation S using undownsampled SDFT coefficients. That is, because of using the whole SDFT coefficient sequence if correlation S is in the neighborhood of threshold T, so that tone determination apparatus 100 can determine correlation S between frames detailedly and accurately, thereby preventing an error in tone determination.

Thus, according to this embodiment, downsampling is performed before determining correlation to shorten SDFT coefficients (vector sequences) as in Embodiment 1, and therefore, the length of the SDFT coefficients (vector sequences) used for calculation of correlation is shorter than that conventionally used. Therefore, according to this embodiment, it is possible to reduce the amount of calculation required for determination of the tonality of an input signal. Furthermore, according to this embodiment, even in the state in which the tonality of an input signal is stable as "toned", detailed and accurate tone determination can be performed by not performing shortening of SDFT coefficients if "toned" and "untoned" may soon be reversed. By this means, it is possible to improve the accuracy of correlation S used for tone determination near a frame where there is a possibility that the tonality of an input signal is reversed (a frame where identification between "toned" and "untoned" is unclear), it is therefore possible to prevent an error in tone determination caused by shortening of SDFT coefficients.

Embodiment 3

Figure 5:
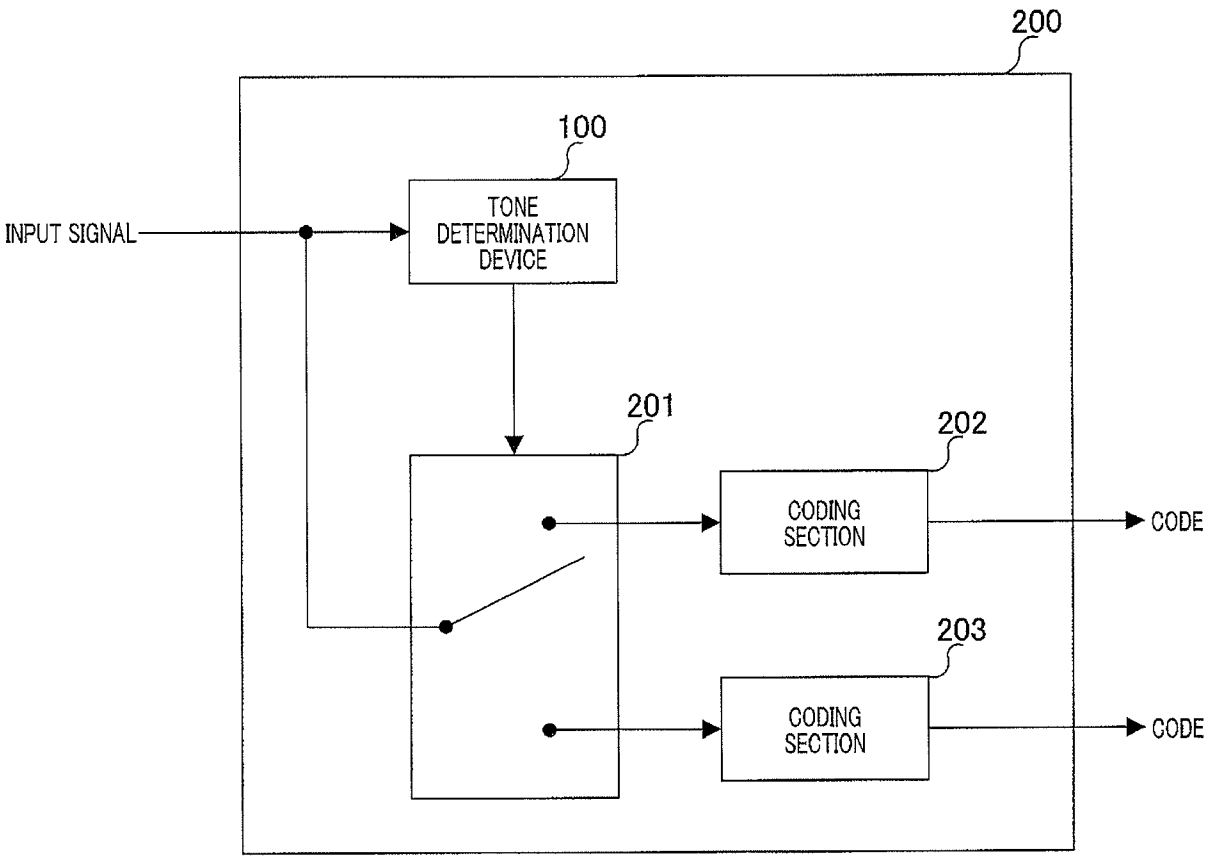
FIG. 5 is a block diagram showing main components of a coding apparatus according to Embodiment 3 of the present invention.

FIG. 5 is a block diagram showing main components of coding apparatus 200 according to this embodiment. Here, the case where coding apparatus 200 determines the tonality of an input signal and switches a coding method according to a determination result will be described as an example.

Coding apparatus 200 shown in FIG. 5 is provided with tone determination apparatus 100 (FIG. 1) according to Embodiment 1 above.

In FIG. 5, tone determination apparatus 100 obtains tone information from an input signal as described in Embodiment 1 above. Next, tone determination apparatus 100 outputs the tone information to selection section 201.

When the tone information is inputted from tone determination apparatus 100, selection section 201 selects an output destination of the input signal according to the tone information. For example, if the input signal is "toned", selection section 201 selects coding section 202 as the output destination of the input signal, and, if the input signal is "untoned", selection section 201 selects coding section 203 as the output destination of the input signal. Coding section 202 and coding section 203 encode the input signal by different coding methods. Therefore, such selection makes it possible to switch the coding method used for coding of an input signal according to the tonality of the input signal.

Coding section 202 encodes the input signal and outputs a code generated by the encoding. Since the input signal inputted to coding section 202 is "toned", coding section 202 encodes the input signal, for example, by frequency transformation coding which is suitable for coding of musical sound.

Coding section 203 encodes the input signal and outputs a code generated by the encoding. Since the input signal inputted to coding section 203 is "untoned", coding section 203 encodes the input signal, for example, by CELP coding which is suitable for coding of speech.

The coding method used for coding by coding sections 202 and 203 are not limited to the above methods, and the most suitable method among conventional coding methods may be appropriately used.

Though the case where there are two coding sections has been described as an example in this embodiment, there may be three or more coding sections which perform coding by different coding methods. In this case, any of the three or more coding sections can be selected according to the degree of tone that is determined by stages.

Though the case where an input signal is any of a speech signal and a musical sound signal has been described in this embodiment, the present invention can be similarly practiced for other signals.

Thus, according to this embodiment, it is possible to encode an input signal by the optimum coding method according to the tonality of the input signal.

Embodiments of the present invention have been described above.

Figure 6A:
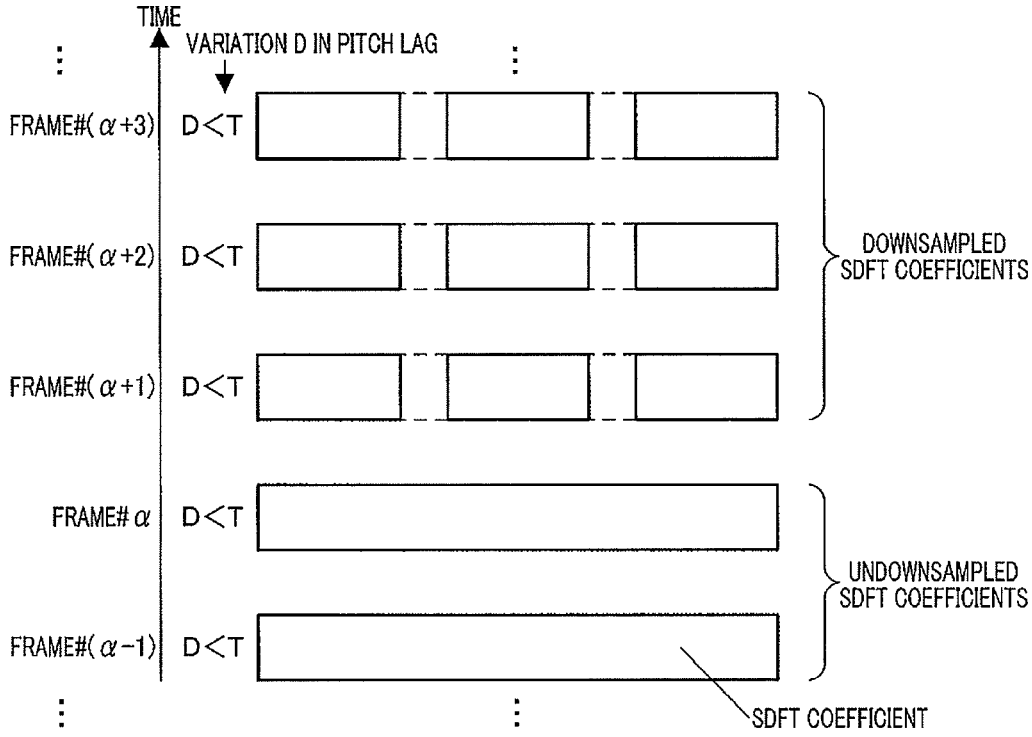
FIG. 6A is a diagram showing a variation of the present invention.
Figure 6B:
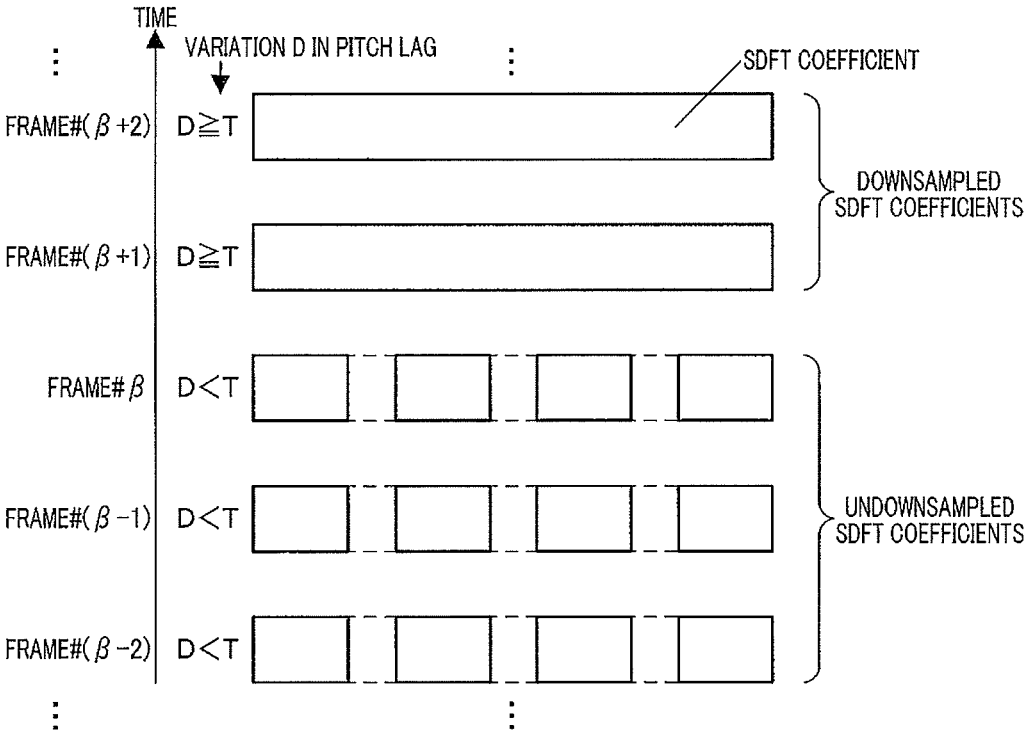
FIG. 6B is a diagram showing a variation of the present invention.

In the embodiments described above, a method for determining the stationarity of an input signal has been described, with the case of using a tonality determination result (tone information) as an example. The method for determining the stationarity of an input signal, however, is not limited to the case of using a tonality determination result, and the stationarity of an input signal may be determined with the use of other indicators. For example, the tone determination apparatus may determine stationarity by measuring the degree of variation in the fundamental frequency determined in an adaptive codebook of the CELP coding. Alternatively, the tone determination apparatus may determine stationarity by measuring variation in pitch lag (or power) between frames obtained from a CELP code of a basic layer in CELP coding. Specifically, as shown in FIG. 6A, if a predetermined number or more of such frames that variation D in pitch lag is below threshold T ($D<T$) do not continuously exist before a current frame (for example, frame #$\alpha$ shown in FIG. 6A), the tone determination apparatus determines that the input signal does not have stationarity. Then, for the frame #$\alpha$, the tone determination apparatus determines correlation using undownsampled SDFT coefficients. As shown in FIG. 6A, if a predetermined number or more of such frames that variation D in pitch lag is below threshold T ($D<T$) continuously exist before a current frame (for example, frame #($\alpha$+1) shown in FIG. 6A), the tone determination apparatus determines that the input signal has stationarity. Then, for the frame #($\alpha$+1), the tone determination apparatus determines correlation using downsampled SDFT coefficients. As shown in FIG. 6B, if the state is reversed from the state in which variation D in pitch lag is below threshold T ($D<T$) to the state in which variation Din pitch lag is equal to or above threshold T ($D\geq T$) (in FIG. 6B, frame #($\beta$+1)), that is, a predetermined number or more of such frames that variation D in pitch lag is below threshold T ($D<T$) do not continuously exist before the current frame, the tone determination apparatus resets shortening of SDFT coefficients.

Frequency transformation of an input signal may be performed by frequency transformation other than SDFT, for example DFT (Discrete Fourier Transform), FFT (Fast Fourier Transform), DCT (Discrete Cosine Transform), MDCT (Modified Discrete Cosine Transform) or the like.

The tone determination apparatus and the coding apparatus according to the above embodiments can be mounted on a communication terminal apparatus and a base station apparatus in a mobile communication system where speech, musical sound and the like are transmitted, and, thereby, it is possible to provide a communication terminal apparatus and base station apparatus giving operation and advantageous effects similar to those described above.

In the embodiments described above, the case where the present invention is configured by hardware has been described as an example. However, the present invention can be realized by software. For example, by writing the algorithm of a tone determination method according to the present invention in a programming language, storing the program in a memory and causing information processing means to execute the program, functions similar to those of a tone determination apparatus according to the present invention can be realized.

Each of the functional blocks used in the description of the above embodiments is realized as an LSI which is typically an integrated circuit. Each of those may be separately contained in one chip, or a part or all of those may be contained in one chip.

Though the integrated circuit is assumed to be an LSI here, it may be referred to as an IC, system LSI, super LSI, ultra LSI or the like according to difference in the degree of integration.

Implementation of the integrated circuit is not limited to an LSI. The integrated circuit may be realized by a dedicated circuit or a general-purpose processor. An FPGA (Field Programmable Gate Array), which is programmable after manufacture of an LSI or a reconfigurable processor in which connection or setting of circuit cells inside the LSI is reconfigurable may be used.

Furthermore, if an integrated circuit implementation technique replacing LSI appears due to progress in semiconductor technology or a derived different technique, integration of the functional blocks may be naturally performed with the use of the technique. The possibility of application of biotechnology and the like is conceivable.

All of the contents disclosed in the specification, drawings and abstract included in Japanese application of Japanese Patent Application 2009-245624 filed on Oct. 26, 2009 are incorporated in this application.

INDUSTRIAL APPLICABILITY

The present invention is applicable to use in speech coding, speech decoding and the like.

REFERENCE SIGNS LIST

100 Tone determination apparatus
101 Frequency transformation section
102 Downsampling section
103 Buffer
104 Vector selection section
105 Correlation analysis section
106 Tone determination section
107 Stationarity determination section
200 Coding apparatus
201 Selection section
202, 203 Coding section

The invention claimed is:

1. A tone determination apparatus for determining tonality of an input signal, comprising:

a transformer that performs frequency transformation of an input signal via a processor;

a shortening part, that shortens processing, via the processor, for shortening a vector sequence length of the frequency-transformed input signal;

a stationarity determiner that determines stationarity, via the processor, of the input signal;

a selector that selects, via the processor, at least one of a vector sequence of the frequency-transformed input signal and a vector sequence after the shortening of the vector sequence length, according to the stationarity of the input signal;

a correlator that determines a correlation, via the processor, using the vector sequence selected by the selector; and a tone determiner that determines, via the processor, a tonality of the input signal using the correlator.

2. The tone determination apparatus according to claim 1, wherein the selector selects the vector sequence of the frequency-transformed input signal when the input signal does not have the stationarity, and selects the vector sequence after the shortening of the vector sequence length when the input signal has the stationarity.

3. The tone determination apparatus according to claim 1, wherein the selector selects the vector sequence of the frequency-transformed input signal when a difference between the correlation and a tone determination reference value is below a value set in advance.

4. The tone determination apparatus according to claim 1, wherein the stationarity determiner determines the stationarity of the input signal based on the tonality of the input signal.

5. The tone determination apparatus according to claim 1, wherein the stationarity determiner determines the stationarity of the input signal based on a pitch lag of the input signal obtained in a basic layer in CELP (Code Excited Linear Prediction) coding.

6. A coding apparatus, comprising:

the tone determination apparatus according to claim 1;

a plurality of coders that encode the input signal, each of the plurality of coders using a different coding method; and the selector selects the coder that performs coding of the input signal, from among the plurality of coders according to a result of the determination by the tone determiner.

7. A communication terminal apparatus comprising the tone determination apparatus according to claim 1.

8. A base station apparatus comprising the tone determination apparatus according to claim 1.

9. A computer-implemented tone determination method, the method performed by a processor, comprising:

frequency transforming of an input signal;

shortening processing for shortening a vector sequence length of the frequency-transformed input signal;

determining stationarity of the input signal;

selecting at least one of a vector sequence of the frequency-transformed input signal and a vector sequence after the shortening of the vector sequence length, according to the stationarity;

determining correlation using the vector sequence selected during the selection; and determining tonality of the input signal using the correlation.

* * * * *